US008911259B2

(12) United States Patent
Liu et al.

(10) Patent No.: US 8,911,259 B2
(45) Date of Patent: Dec. 16, 2014

(54) POWER SUPPLY MODULE

(71) Applicants: Hong Fu Jin Precision Industry (ShenZhen) Co., Ltd., Shenzhen (CN); Hon Hai Precision Industry Co., Ltd., New Taipei (TW)

(72) Inventors: Lei Liu, Shenzhen (CN); Guo-Yi Chen, Shenzhen (CN)

(73) Assignees: Hong Fu Jin Precision Industry (ShenZhen) Co. Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/927,947

(22) Filed: Jun. 26, 2013

(65) Prior Publication Data

US 2014/0179144 A1 Jun. 26, 2014

(30) Foreign Application Priority Data

Dec. 21, 2012 (CN) ..... 2012 1 0560989

(51) Int. Cl.
*H01R 25/00* (2006.01)
*H01R 13/74* (2006.01)

(52) U.S. Cl.
CPC ..... *H01R 13/745* (2013.01); *Y10S 439/954* (2013.01)
USPC ..... 439/640; 439/954

(58) Field of Classification Search
USPC ..... 439/131, 142, 151, 177, 217, 218, 640, 439/954
See application file for complete search history.

(56) References Cited

U.S. PATENT DOCUMENTS

| | | | | |
|---|---|---|---|---|
| 6,780,038 | B1 * | 8/2004 | Huang | 439/640 |
| 6,805,565 | B1 * | 10/2004 | Chiang et al. | 439/640 |
| 7,104,837 | B1 * | 9/2006 | Huang | 439/954 |
| 7,214,102 | B2 * | 5/2007 | Chong | 439/640 |
| 7,264,514 | B2 * | 9/2007 | Hsu et al. | 439/640 |

* cited by examiner

*Primary Examiner* — Tho D Ta
(74) *Attorney, Agent, or Firm* — Novak Druce Connolly Bove + Quigg LLP

(57) ABSTRACT

A power supply module includes a sidewall, a socket detachably mounted to the sidewall, and a latch rotatably connected to the sidewall. An opening is defined in the sidewall. The socket includes a base engaging in the opening, and a mounting plate abutting an outer surface of the sidewall. A block is formed on the outer surface of the sidewall adjacent to a side of the opening, to abut a first side of the mounting plate. The latch is capable of being rotated to abut a second side of the mounting plate opposite to the first side.

4 Claims, 5 Drawing Sheets

POWER SUPPLY MODULE

BACKGROUND

1. Technical Field

The present disclosure relates to a power supply module.

2. Description of Related Art

The arrangement of interface pins of power supply modules are usually standard, and plugs are usually plugged into the interfaces at a fixed angle. When space at the interface of the power supply module is limited, some plugs may not plug into the interface of the power supply module in the established angle, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The disclosure, including the accompanying drawings in which like references indicate similar elements, is illustrated by way of examples and not by way of limitation. It should be noted that references to "an" or "one" embodiment in this disclosure are not necessarily to the same embodiment, and such references mean "at least one."

Figure 1:
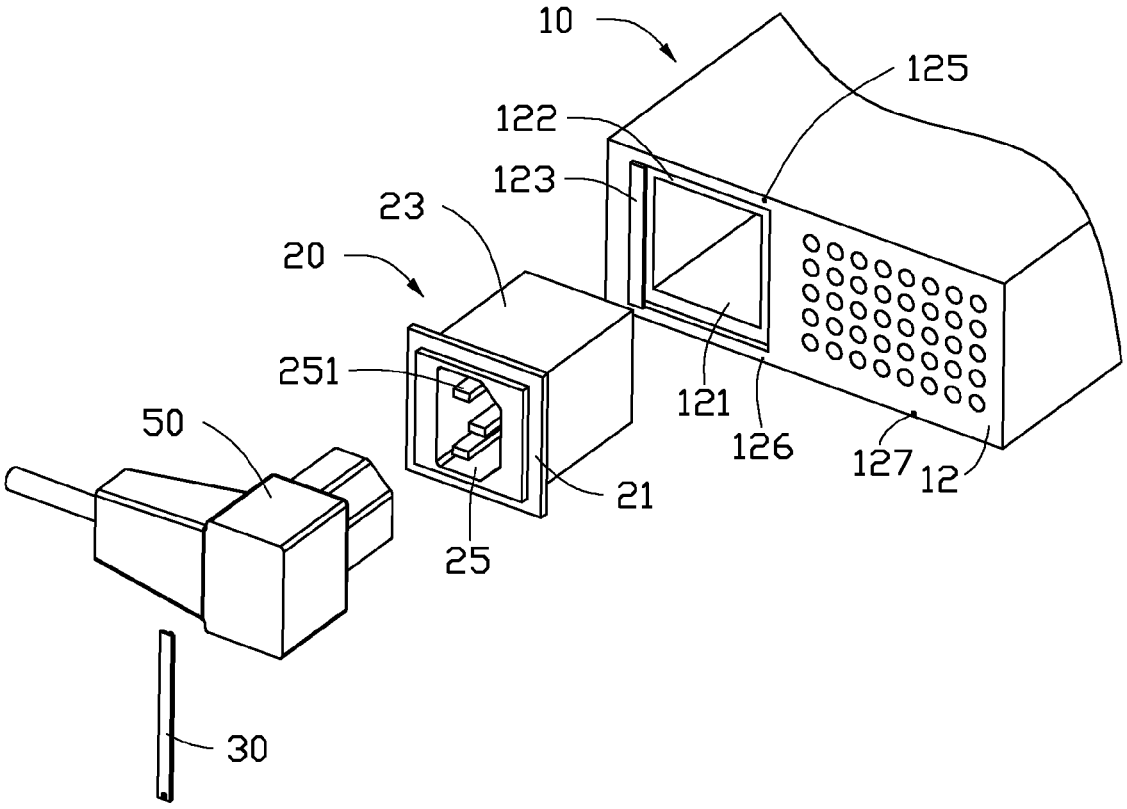
FIG. 1 is an exploded, isometric view of an embodiment of a power supply module and a plug, the power supply module including a latch.
Figure 2:
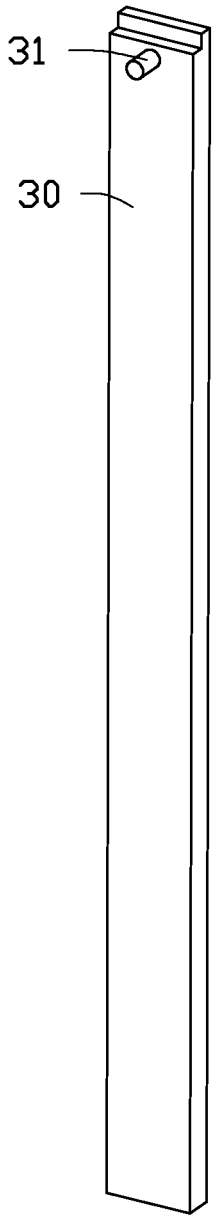
FIG. 2 is an enlarged view of a latch of FIG. 1, but viewed from another aspect.

FIG. 1 and FIG. 2 show an embodiment of a power supply module. The power supply module includes a housing 10, a socket 20, and a latch 30.

The housing 10 includes a sidewall 12 defining a rectangular opening 121. An annular and rectangular slot 122 is defined in the sidewall 12, around the opening 121. A block 123 extends from the sidewall 12, adjacent to a first side of the slot 122 opposite to the opening 121. A first locking hole 125 and a pivot hole 126 are defined in the sidewall 12, respectively located above and below a second side of the slot 122 opposite to the block 123. A second locking hole 127 is defined in the sidewall 12, at the second side of the slot 122 and away from the slot 122. A distance between the second locking hole 127 and the pivot hole 126 is equal to a distance between the first locking hole 125 and the pivot hole 126.

The socket 20 includes a mounting plate 21 and a base 23 formed at a rear side of the mounting plate 21. A plugging hole 25 is defined in the base 23 and extends through the mounting plate 21. Three plugging pins 251 are arranged in the plugging hole 25.

The latch 30 is substantially bar-shaped, and includes a locking pin 31 formed at one end of the latch 30.

Figure 3:
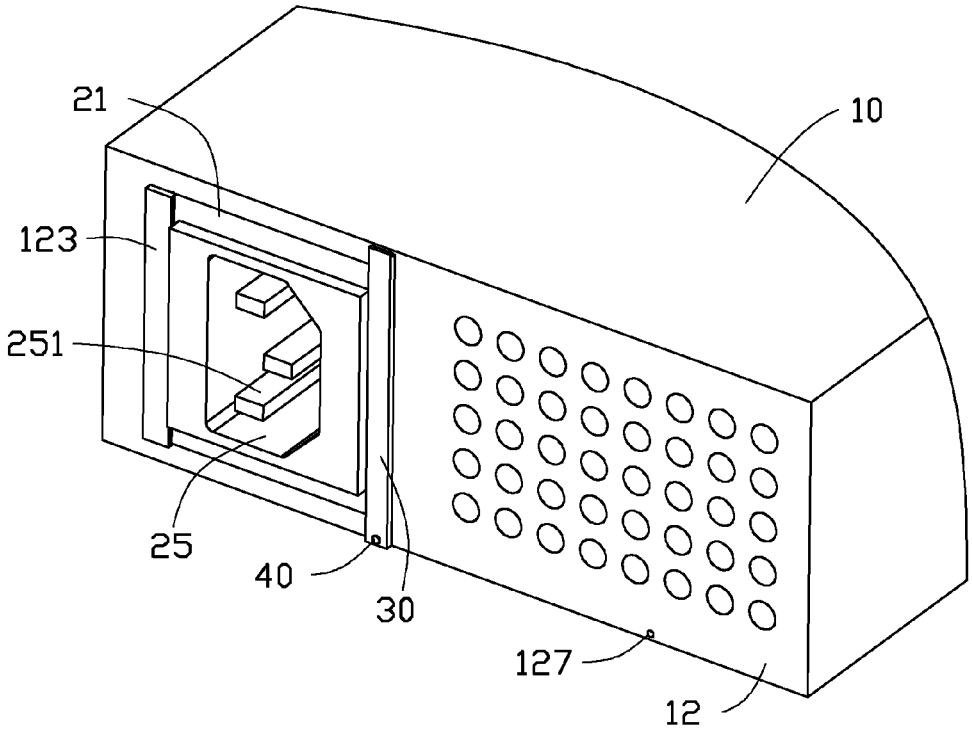
FIG. 3 is an assembled, isometric view of the power supply module of FIG. 1.
Figure 4:
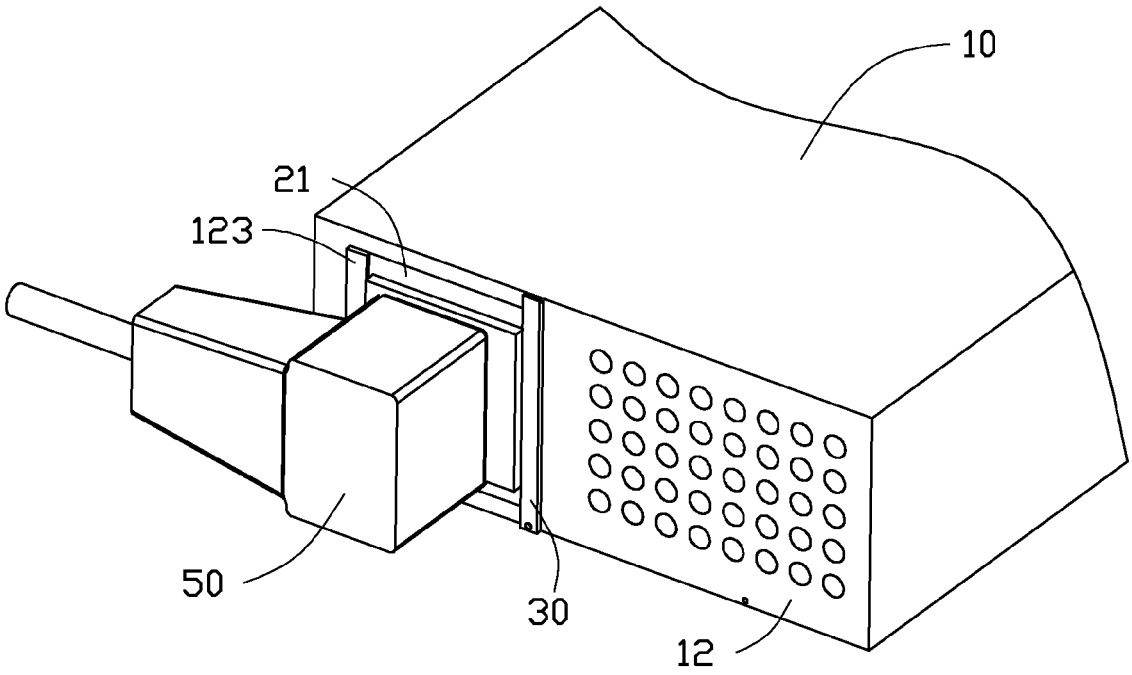
FIG. 4 is an assembled, isometric view of FIG. 1.
Figure 5:
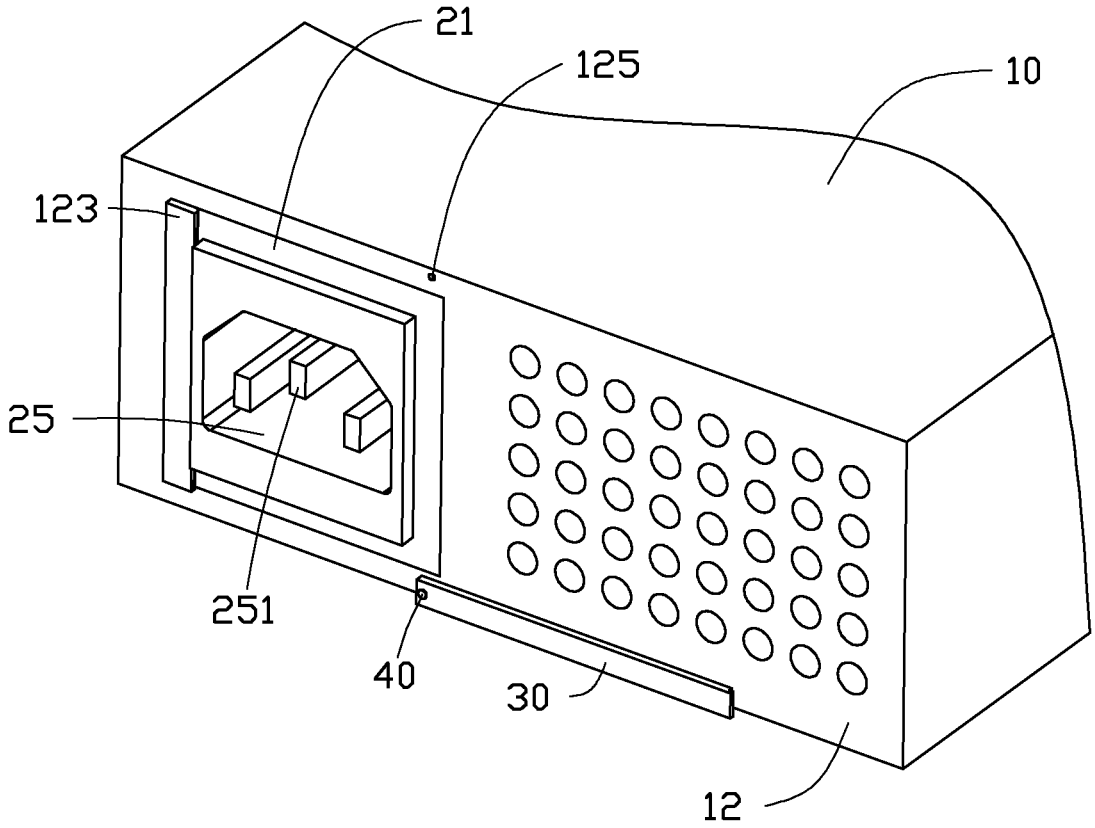
FIG. 5 is similar to FIG. 3, but shown at another state.

FIG. 3 to FIG. 5 show that in assembly, one end of the latch 30 away from the locking pin 31 is pivotably attached to the pivot hole 126 with a fastener 40, such as a bolt. The locking pin 31 faces the sidewall 12. The base 23 is inserted in the opening 121. A first side of the mounting plate 21 is received in the first side of the slot 122 and blocked by the block 123, to be sandwiched between the sidewall 12 and the block 123. A second side of the mounting plate 21 is received in the second side of the slot 122. The latch 30 is rotated up, until the locking pin 31 engages in the first locking hole 125. The second side of the mounting plate 21 is blocked by the latch 30 to be sandwiched between the sidewall 12 and the latch 30. Thus the socket 20 is fixed to the sidewall 12. A plug 50 can then be received in the socket 20.

When there is a need to adjust a plugging direction of the plug 50, the locking pin 31 is released from the first locking hole 125. The latch 30 is rotated down until the locking pin 31 is engaged in the second locking hole 127. The socket 20 is moved until the first side of the mounting plate 21 is released from the block 123. The socket 20 is rotated to adjust the positions of the plugging pins 251. The socket 20 is then mounted to the sidewall 12 as described above. Thus, the plug 50 can be rotated to a desired angle, and then received in the socket 20.

In other embodiments, the second locking hole 127 can be omitted.

Even though numerous characteristics and advantages of the embodiments have been set forth in the foregoing description, together with details of the structure and function of the embodiments, the disclosure is illustrative only, and changes may be made in detail, especially in the matters of shape, size, and arrangement of parts within the principles of the present disclosure to the full extent indicated by the broad general meaning of the terms in which the appended claims are expressed.

What is claimed is:

1. A power supply module, comprising:

a housing comprising a sidewall defining an opening, and a block formed on the sidewall adjacent to a first side of the opening;

a socket comprising a mounting plate, a base received in the opening, and a plurality of plugging pins, wherein a plugging hole is defined in the base and extends through the mounting plate, the plugging pins are arranged in the plugging hole, and a first side of the mounting plate is sandwiched between the sidewall and the block; and a latch pivotably attached to the sidewall adjacent to a second side of the opening opposite to the first side of the opening, wherein the latch is rotatable to block a second side of the mounting plate opposite to the first side of the mounting plate.

2. The power supply module of claim 1, wherein the sidewall defines an annular slot around the opening, and sides of the mounting plate are received in the slot.

3. The power supply module of claim 1, wherein a first end of the latch is pivotably mounted to the sidewall, the latch comprises a locking pin formed at a second end of the latch opposite to the first end, a first locking hole is defined in the sidewall adjacent to the second side of the opening, and the locking pin is detachably engaged in the first locking hole to position the latch.

4. The power supply module of claim 3, wherein a second locking hole is defined in the sidewall at the second side of the opening and away from the slot, and the latch is rotated until the locking pin is engaged in the second locking hole to release the second side of the mounting plate from the sidewall.

* * * * *